United States Patent [19]

Iihama et al.

[11] Patent Number: 4,917,317

[45] Date of Patent: Apr. 17, 1990

[54] TOROIDAL COIL WINDING MACHINE

[75] Inventors: Takao Iihama; Hidekazu Wada, both of Niigata, Japan

[73] Assignee: Alps Electric Co., Ltd., Tokyo, Japan

[21] Appl. No.: 266,312

[22] Filed: Oct. 31, 1988

Related U.S. Application Data

[63] Continuation-in-part of Ser. No. 20,468, Mar. 2, 1987, abandoned.

[30] Foreign Application Priority Data

Jul. 16, 1987 [JP] Japan ..... 61-167557

[51] Int. Cl.[4] ..... H01F 41/08

[52] U.S. Cl. ..... 242/4 R; 242/4 C; 29/605; 140/147

[58] Field of Search ..... 242/4 C, 4 R, 1.1 R; 29/605; 140/147; 72/318, 274, 291

[56] References Cited

U.S. PATENT DOCUMENTS

| | | | |
|---|---|---|---|
| 4,412,566 | 11/1983 | Huffnagle | 140/147 |
| 4,464,919 | 8/1984 | Labbe | 140/147 X |
| 4,564,998 | 1/1986 | Perschka | 242/4 R X |
| 4,568,032 | 2/1986 | Ishida | 242/4 C X |
| 4,625,927 | 12/1986 | Arnold | 242/4 R |
| 4,727,912 | 3/1988 | Gonzalez | 140/147 |

FOREIGN PATENT DOCUMENTS

| | | |
|---|---|---|
| 00077 | 1/1984 | European Pat. Off. . |
| 54867 | 5/1975 | Japan . |
| 148812 | 11/1981 | Japan . |

*Primary Examiner*—Katherine A. Matecki
*Attorney, Agent, or Firm*—Guy W. Shoup; Paul J. Winters; Stephen J. Malaska

[57] ABSTRACT

A toroidal coil winding machine for winding a wire in a coil on a work such as a toroidal core of a magnetic head comprises, as the principal components, a rotary table for fixedly holding a work thereon, capable of being turned intermittently through an angle of 180° at a time, a pair of mobable arms disposed on the diametrically opposite sides of the rotary table, respectively, provided with mechanical hands for gripping a wire, respectively, and capable of being moved between the respective front positions and the back positions, a clamping device for holding one free end of the wire, mounted on the rotary table, a loop holding device for holding loops of the wire wound on the work while the rotary table is stopped, mounted on the rotary table, a wire reel for feeding the wire, a wire holder disposed near the wire reel for temporarily holding the wire drawn out from the wire reel, and a cutter disposed near the wire holder for cutting the wire in a predetermined length. The movable arms are advanced to the front positions, respectively to transfer the other free end of the wire from one to the other or from the other to the one of the mechanical hands. After the other free end of the wire has been passed through an opening formed in the work and has been gripped by one or the other of the mechanical hands, the rotary table is turned through an angle of 180° to wind the wire on the work.

4 Claims, 4 Drawing Sheets

TOROIDAL COIL WINDING MACHINE

This is a continuation-in-part of application Ser. No. 020,468, filed Mar. 2, 1987 now abandoned. The entire disclosure of application 020,468 is incorporated herein by reference.

DETAILED DESCRIPTION OF THE INVENTION

1. Field of Art

This invention relates to a toroidal coil winding machine for winding a wire in order in a closed coil hole.

2. Prior Art and its Problems

The toroidal coil winding machine is known as a machine for winding a wire in a closed coil hole or the like of a magnetic head and a rotor of a motor (hereinafter called a work or workpiece). However, since all prior coil winding machines are constituted to wind the wire by rotating an arm for holding and releasing the wire inserted into the coil hole around the work having the coil hole, the machine was made large-sized and the structure was inevitably complicated. Particularly when the wire is wound in an extremely small coil hole like that of a magnetic head, the winding itself becomes difficult and the orderly winding is almost impossible unless the end of wire is located and guided into the coil with high accuracy. Thus, the prior machine cannot be practically applied to the small hole so that in practice an operator carried out the coil winding manually.

SUMMARY OF THE INVENTION

An object of this invention is to provide a compact toroidal coil winding machine which can overcome problems in such machines and suitably orderly wind a wire in a coil hole of a small part such as a magnetic head.

This invention innovates over prior machines constituted basically to rotate an arm holding a wire around a work and provides a completed coil winding machine based on a new idea of rotating a table for supporting the work.

That is, this invention is characterized in that a work having a coil hole is supported by a rotary table rotated intermittently through an angle of 180° at a time, while a wire fixing means for supporting an end of the wire to be inserted into the coil hole of work is provided on the rotary table; a pair of left and right movable arms are disposed at both sides of the rotary table to move to and away from the rotary table and support hands pivotable about a rotary shaft parallel to the rotary axis of the rotary table to hold and release the wire; on the rotary table are provided respectively a centering means for locating a free end of the wire toward the center of the coil hole when the wire is inserted into the coil hole by the hands, a guide means for guiding the free end of wire located by the centering means to the center of the coil hole, a wire delivering means disposed through the work at the opposite side to the guide means to move to and away from the coil hole, hold the free end of wire inserted into the coil hole by one hand for locating said end and locate said end to a fixed dimension while delivering said end to the other hand, a vertical positioning moving means for vertically moving the rotary table by a fixed dimension corresponding to the diameter of wire at a time and arranging orderly the wire to be wound in the coil hole and further a coil holding means for contacting the outside of a coil pole time the wire is wound around the coil pole of the workpiece so as to prevent the wire from loosening, wherein the free end side of wire with one end being supported on the rotary table by said fixing means is repeatedly inserted, arranged orderly and wound in the coil hole of the workpiece by synchronous movement such as the movement of the movable arm to and away from the rotary table in its stopped state, the movement of one hand for holding and releasing the wire, the movement of guide means for guiding the wire, the movement of wire delivering means for delivering the wire to the other hand, the movement of hand for converting direction by rotation the rotational vertical positioning movement of rotary table and the movement of coil holding means for holding the wire to the coil pole.

BRIEF DESCRIPTION OF THE DRAWINGS

FIG. 7 shows the centering means in FIG. 6, FIG. 7(*a*) being a front view showing the state of centering means before moving and FIG. 7(*b*) being a front view showing the same after moving.

FIG. 8 is an enlarged sectional view showing the guide means in FIG. 6.

FIG. 9 is a partially cut-way front view showing a wire delivering means in relation to the work according to this invention.

FIG. 10 is a sectional view showing another example of a vacuum path in the wire delivering means in FIG. 9.

FIG. 11 is a front view showing an example of a vertical positioning moving means according to this invention.

FIG. 12 is a front view showing a coil holding means and parts related thereto according to this invention.

FIG. 13 shows the relationship between a magnetic head core on a rotary table, a wire inserted into a coil hole of the magnetic head core and a handle for grasping the wire, FIG. 13(*a*) being a schematic plan view showing the state of rotary table before rotation and FIG. 13(*b*) being same showing the state of rotary table after rotation of 180°.

DETAILED DESCRIPTION OF THE INVENTION

Figure 2A:
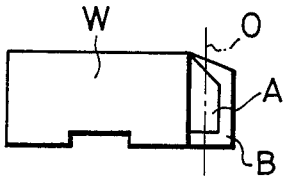
FIG. 2 shows a magnetic head core as a work of an object of this invention, FIG. (2) being a front view thereof and FIG. 1(*b*) a plane view of same.
Figure 2B:
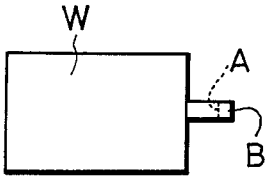

Hereinafter will be described this invention with reference to an illustrated embodiment. FIG. 2(*a*), (*b*) show a magnetic head core W as an object of this invention, having a coil hole A closed at one end.

Figure 1:
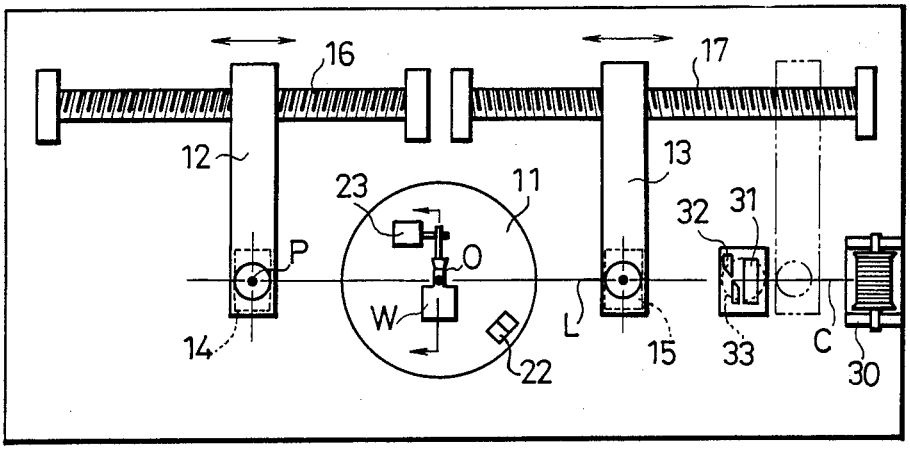
FIG. 1 is a plane view showing a toroidal coil winding machine according to this invention.
Figure 3:
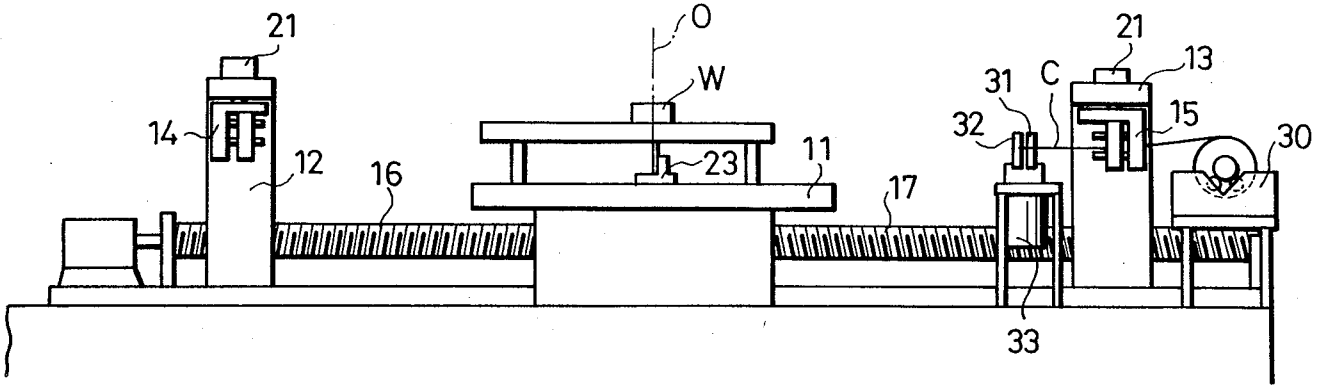
FIG. 3 is a front view showing said machine in FIG. 1.

This toroidal coil winding machine for inserting a wire C into the coil hole A of magnetic head core W and winding a coil around a coil pole B, as shown in FIG. 1 and 3, is constituted mainly from a work station 11 on which the magnetic head core W is fixedly mounted, a rotary table 12 mounting this work station 11,, left and right movable arms 13,14 on this rotary table 12 and hands 15,16 provided on ends of these movable arms 13,14. The work station 11 supports removably the magnetic head core W by a vacuum mechanism for example. Also, the rotational center 0 of rotary table 12 coincides with a lateral bisector of the coil hole A of magnetic head core W fixed to the work station 11.

The movable arms 13,14 can be moved left and right as viewed in FIG. 1 by a well-known feed mechanism comprising feed screws 17,18.

Figure 4:
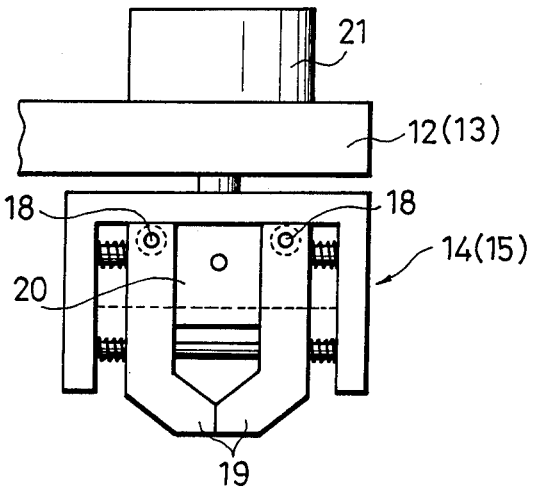
FIG. 4 is a front view showing a hand portion according to this invention.
Figure 5:
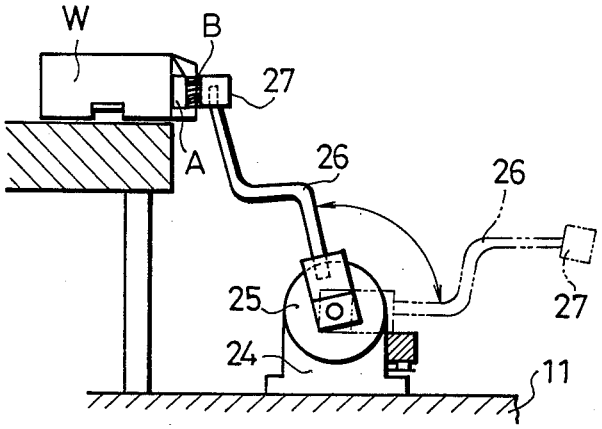
FIG. 5 is a sectional view taken along the line V—V in FIG. 4, showing also the operative state of the hand portion.

The hands 15,16 on ends of the movable arms 13,14 hold and release the wire C to be inserted into the coil hole A, the constitution thereof being shown in FIG. 4 and 5. Namely, the hands 15,16 have respectively a pair of fixed-position pawl members 21 and a pair of movable pawl members 22 opened and closed about a pair of common guide shafts 20 in a holder 19. The wire C is held between ends of both pawl members 21,22. The fixed-position pawl member 21 is disposed on one end of a holder 19 and held inserted in upper and lower shafts 23,24 extended between side walls of holder 19. To the upper and lower shafts 23,24 between the side walls of holder 19 and the fixed-position pawl member 21 are attached respectively compression springs 25,26 to urge the fixed-position pawl member 21 in the closing direction The compression springs 25,26 are set with a strong urging force sufficient to fix the wire C when the end of fixed-position pawl member 21 holds the wire C. The operation of the fixed-position pawl 21 holds the wire C. The operation of the fixed-position pawl 21 is carried out by an actuator 27. Also, the movable pawl member 22 can be moved to and away from the fixed-position pawl member 21 by a guide shaft 20. A compression spring 28 is attached to the guide shaft 20 to urge the movable pawl member 22 in the direction of abutting against the fixed-position pawl member 21. And the movable pawl member 22 is moved away from the fixed-position pawl member 21 by an air cylinder not shown. FIG. 5 shows movable pawl member 22 in both its open and closed positions. Also, the movable pawl member 22 is opened and closed by an actuator 29. A holding force of the movable pawl member 22 for the wire C when the-movable pawl member 22 is closed by the actuator 29 is set weaker than the holding force of said fixed-position pawl member 21. The position of wire C held by the fixed-position pawl member 21 and the movable pawl member 22 in the hands 15,16 constituted as above mentioned coincides with a straight line L passing through the rotary center 0 of rotary table 12.

Also, the hands 15,16 having the rotary center P of rotary shaft 30 on a straight line L are supported rotatably by the movable arms 13,14. This rotary center P in this embodiment is in the intermediate position of hands 15,16, i.e., a position deviated to the fixed-position pawl member 21 side from a position S at which the fixed-position pawl member 21 abuts against the movable pawl member 22. Thus, when the hands 15,16 are rotated by 180°, as shown in FIG. 5, the fixed-position pawl member 21 is left as it is and only the movable pawl member 22 is located at the opposite side to the original position. A rotary actuator designated by 31 rotates the hands 15,16 through an angle of 180° at a time so that the hands 15,16 place a pair of both pawl members 21,22 symmetrically about the straight line L in their stopped state. Namely, they can hold and release the wire C located on the straight line L.

The rotary table 12 is also intermittently rotated through an angle of 180° at a time and stopped at a position where the direction of coil hole A of magnetic head core W is orthogonal to the direction of straight line L, in other words, a position where the wire C transferred on the straight line L passes through the coil hole A. Also, on the work station 11 mounted on the rotary table 12 is provided a fixing means 32 for fixing the end of wire C.

On the work station 11 are disposed the centering means 33 and the guide means 34 at one side of the magnetic head core W and the wire delivering means 35 at the other side with the centers being located on the straight line L.

Figure 6A:
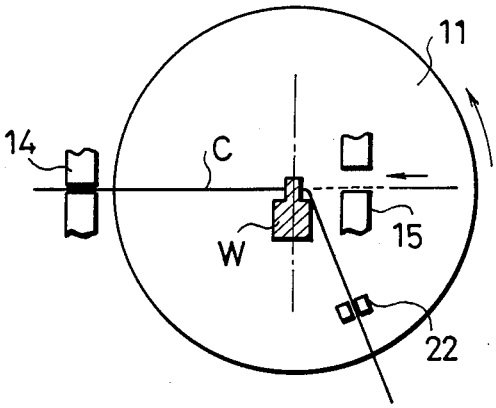
FIG. 6 is a plan view showing the centering means and the guide means according to this invention by the positional relationship between the work and the hand.
Figure 6B:
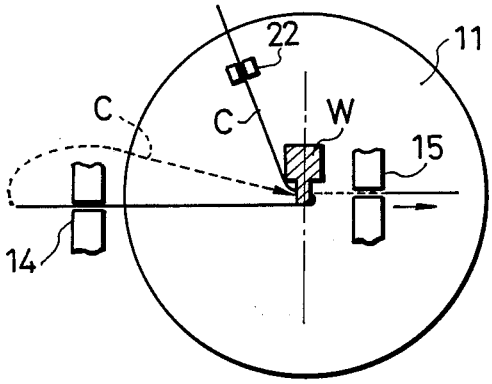

The centering means 33 inserts securely the free end of wire C held by the hand 15 or 16 into the coil hole A of magnetic head core W and, as shown in FIG. 6 and 7, consists of a pair of left and right shutter members 36,37 movable in the direction orthogonal to the direction of inserting the wire C. The shutter members 36,37 are provided on the ends respectively with wedge-like notches 36*a*, 37*a* and a rhombus shaped space surrounded by these wedge-like notches 36*a*, 37*a* is gradually narrowed by moving the shutter members 36,37 towards each other in the direction of the arrow so that the free end of wire C is located on the straight line L, i.e., on the center of coil hole A of magnetic head core W.

The guide means 34 guides the free end of wire C located by the centering means 33 to the center of coil hole A and, as shown in FIG. 8, is provided with a bellmouth-like hole 38 and a guide portion 39. The bellmouth-like hole 38 having its center on the straight line L is formed tapered axially around the wire C and its opening is opposed to the rhombus shaped space formed by the wedge-like notches 36*a*, 37*a* of the centering means 33. This bellmouth-like hole 38 puts the free end of wire C toward the center along the tapered portion. The guide portion 39 is opposed parallel to the shoulder D of magnetic head core W to guide the free end of wire C passing through the bellmouth-like hole 38 to the center of coil hole A while said end bears against the inner surface guide 40 of guide portion 39.

The wire delivering means 35 delivers the free end of wire C inserted into the coil hole A of magnetic head core W through the centering means 33 and the guide means 34 by one hand 15 or 16 to the other hand 16 or 15 by utilizing a vacuum. As shown in FIG. 9, the delivering means 35 is provided with a suction unit body 42 formed in the inside with a suction path 41, a suction pipe 43 projecting from the suction unit body 42 and having an opening end of extending suction path 41 opposed to the coil hole A and a vacuum path 44 communicating to the suction path 41 on the way to the terminal end 41*a*. The suction unit body 42 is mounted on a guide shaft 45 disposed along the straight line L and guided by a cylinder bearing (not shown) to the guide shaft 45 to move to and away from the magnetic head core W. The suction pipe 43 sucks and holes by the vacuum the free end of wire C inserted into the coil hole A by the hand 15 or 16 in the suction path 41. Also, the vacuum path 44 communicates orthogonally to the suction path 41. Under such communicating state of the vacuum path 44, the free end of wire C at the On state of vacuum bears always against the terminal end 41*a* of suction path 41. FIG. 10 shows another example of the vacuum path 44 communicating to the suction path 41, in which the vacuum path 44 having the vacuum direction directed slantwise to the magnetic head core W side communicates obliquely to the suction path 41. Thus, the wire C can be also sucked up to a desued position. And such wire delivering means 35 sucks and holds the free end of wire C inserted into the coil hole A by the suction path 41 at the advance position and delivers the wire to the other hand 16 or 15 on the intermediate position. Then, the vacuum is turned OFF to release the free end of wire C from the suction path 41 on the retreat position. Further, said wire delivering means 35 is provided with a lift mechanism (not shown) to be lowered to the shunting position after moving to said retreat position.

Said rotary table 12 is provided with a vertical positioning moving means 46 to arrange the wire C inserted into the coil hole A and wound around the coil pole B in the winding direction. This size-vertical moving means 46, as shown in FIG. 11, is located below the rotary center 0 of rotary table 12 and constituted principally of stepping motor 47, a coupling 48 and a feed screw 49. The stepping motor 47 rotates through a fixed angle at every one pulse of electrical signal. Also, the feed screw 49 receives the rotation of stepping motor 47 through the coupling 48 and functions to vertically move the rotary table 12. The feed screw 49 is connected to the rotary table 12 through a nut 50 screwed onto the feed screw 49 for example and a bearing 51 interposed between the outer periphery of nut 50 and the inner periphery of rotary table 12. By such a constitution are carried out the intermittent rotation and vertical motion of rotary table 12 without any interference with each other. Further, a rotary drive mechanism for the rotary table 12 is not shown. A vertically moving amount of the rotary table 12 at a time due to the feed screw 49 is preset according to the diameter of wire C so that the rotary table 12 is moved vertically by an amount corresponding to the wire diameter while rotating itself by one rotation. Further, as shown in the drawing, a locating sensor 52 detects elements 53 provided on the outer periphery of rotary table 12 at intervals of 180° to be detected by said sensor 52 and stops the rotary table 12 at every angle of 180°. Further, on the rotary table 12 is provided a coil holding means 54. As shown in FIG. 12, the coil holding means 54 fixes a holding arm 57 to a rotor 56 of a rotary actuator 55 and a holding rubber 58 contacting the outside of coil pole B of magnetic head core W is provided on an end of the holding arm 57. The rotary actuator 55 moves the holding rubber 58 into contact with the outside of coil pole B to prevent the wire C wound around the coil pole B from loosening. During the rotation of rotary table 12 the holding arm 57 and the holding rubber 58 are released from the magnetic head core W as shown by the two-dot chain line.

Further in FIG. 1, a wire reel 59 around which the wire C is wound, a holder 60 for holding the wire C drawn out of the wire reel 59 and a cutter 61 for cutting off the wire C are all together moved vertically toward the straight line L by a cylinder unit 62.

This apparatus thus constituted is operated as follows: the end of wire C drawn out of the wire reel 59 is held by a guide not shown. First, in the retreat position a (position spaced from the rotary table 12, and hereinafter same as above the movable arm 14), the hand 16 grasps the end of wire C and the movable arm 14 advances up to a predetermined position i.e. (moves toward the rotary table 12 and hereinafter the same as above) so that the wire C is drawn out by a fixed amount. Then, since the a holding force of the fixed position pawl member 21 is stronger than that of the movable pawl member 22, the wire C is fixed by the fixed-position pawl member 21. As the wire C is drawn out, an air cylinder (not shown) of the hand 16 is operated to move the movable pawl member 22 holding loosely the wire on the one hand away from the fixed-position pawl member 21. By the movement of the movable pawl member 22 the free end is drawn linearly of held wire C through said member 22 to correct the bend of wire. Thus the movable pawl member 22 operates repetitively to alternately feed and straighten the wire C. Next, the cylinder unit 62 is operated to lift the holder 60 and the cutter 61. After the holder 60 holds the wire C and the cutter 61 cuts off the wire C, the holder 60 releases the wire C, and then the holder 60 and the cutter 61 are lowered by the cylinder unit 62. Thereafter, when the hand 16 is advanced by the movable arm 14 and the free end of held wire C reaches the position of centering means 33, the shutter members 36,37 of centering means 33 are moved toward the wire C to narrow the rhombus shaped space formed of the wedge-like notches **36*a*, 37*a* and locate the wire C on the straight line L passing through the center of coil hole A. Thus, the free end of wire C is located in the center of coil hole A. Next, the wire C is guided by the guide means 34 and the free end is urged to the center of bellmouth-like hole 38 along the tapered portion. The free end is further moved while bearing against the inner surface guide 40 of guide portion 39** and after guided to the center of coil hole A, inserted into the coil hole A. Thus, the wire C is securely inserted in the center of the coil hole A.

Then, the wire delivering means 35 stands by in the advance position for the magnetic head core W to turn ON vacuum so that the free end of wire C is sucked from the suction pipe 43 into the suction path 41 and the end of wire C abuts against the terminal and **41*a*. When the free end of wire C is sucked and held by the suction path 41, the wire delivering means 35 retreats to the intermediate position and then stops. Then, the movable arm 13 and the hand 15 stand by at the advance position for the rotary table 12 to grasp the free end of wire C inserted into the coil hold A. Then, the free end of wire C is delivered to the hand 15. At the same time, vacuum in the wire delivering means 35 is turned OFF and the wire delivering means 35 retreats further to the retreat position so that the wire C is moved away from the suction path 41 of the suction pipe 43. The wire delivering means 35 is lowered and shunted to a position not interfering with the hand 15 by a lift means not shown. The hand 15 holding the free end of wire C, similarly in the case of said hand 16 draws the free end through the movable pawl member 22 for correction. Then, the end of cut-off wire C is fixed by the fixing means 32**. This fixation may be carried out by a guide mechanism provided for the wire C or manually by an operator.

According to the above-mentioned processes, a predetermined length of wire C is drawn out a time, the free end thereof is inserted in the coil hole A of magnetic head core W and the other end will be fixed to the fixing means 32 on the rotary table 12.

Next, the movable arms 13 and 14 retreat to a position where they do not interfere with the rotary table 12 and there the rotary table 12 is rotated through an angle of 180° in the direction of arrow in FIG. 13(*a*). Then, the wire C will be wound by half rotation around the coil pole B of magnetic head core W as shown in FIG. 13(*b*).

Under such condition, the coil holding means 54 moves the holding rubber 58 into contact with the outside of coil pole B of magnetic head core W to prevent the coil from loosening. And the hand 15 is also rotated 180° by the rotary actuator 31 to direct again the end of hand held wire C of the magnetic head core W. Then, the movable arm 13 advances to the rotary table 12, the free end of the arm held wire C is again located on the straight line by the centering means 33 and inserted into the coil hole A after guided to the center of coil hole A by the guide means 34. Then, the wire delivering means 33 again stands by at the advance position for the magnetic head core W and vacuum is turned ON so that the free end of wire C inserted again into the coil hole A is sucked and held by the suction path 41 and the wire delivering means 35 retreats to the intermediate position. The movable arm 14 also reaches again the advance position until then and the hand 16 stands by in the state of 180° rotation. That is, when the wire C is inserted into the coil hole A, the movable pawl member 22 located near the magnetic head core W side is moved away from said core W side by the rotation about the rotary center P of rotary shaft 30 to deviate the holding position of wire C. Thus, the holding position of wire C is deviated by the holding in the insertion and the holding in the receipt, and particularly in the insertion the movable pawl member 22 is adapted to approach the magnetic head core W so that the free end of wire C is easily inserted into the coil hole A. And the free end of wire C sucked and held by the wire delivering means 35 is received by the fixed-position pawl member 21 and the movable pawl member 22, and on the other hand the hand 15 of the movable arm 13 releases the wire C held thereby. Also, the wire delivering means 35 retreats with vacuum turned OFF to release the free end of wire C from the suction path 41.

Next, the movable arms 13,14 retreat again to the position where they do not interfere with the rotary table 12 and then the hand 16 of movable arm 14 winds the wire C firmly around the coil pole B.

Further, the hand 16, while holding the wire C, is again rotated 180° to direct the end toward the magnetic head core W and advances toward the rotary table 12 to insert the free end of wire C into the coil hole A through the centering means 33 and the guide means 34. And the hand 15 reaching again the advance position then receives again the free end of wire C sucked and held by the wire delivering means, and on the other hand the wire C held by the hand 16 is released. When both hands retreat to the position where they do not interfere with the rotary table 12, the rotary table 12 is again further rotated 180°.

While the rotary table 12 is rotated by one rotation, then the size-vertical moving means 46 works so that the rotary table 12 is moved with the operation of stepping motor 47 and the feed screw 49 either upward or downward by the diameter of wire C. That is, when the wire C is wound downward of the coil pole B, the rotary table 12 is lowered and, when wound upward, raised. Thus, the wound wire C will be wound in order adjacent the previously wound wire. This vertical positioning moving means 46 works at each rotation of rotary table 12 and the sequential repetition thereof will wind the wire C around the coil pole B.

Hereinafter the wire C is wound around the coil pole B through the coil hole A of magnetic head core W by the continuous operations of the retreat of the holding rubber 58 of coil holding means 54 from the coil pole B, the 180° rotation of rotary table 12, the contact of holding rubber 58 of coil holding means 54 with the coil pole B, the advance of movable arms 13,14 to the rotary table 12, the location of free end of wire C held by one hand 16 or 15 to the coil hole A, the location and guide of said free end by the centering means and the guide means 34, the delivery of the wire C to the other hand 15 or 16 by the delivering means 35, the retreat of movable arms 13,14, the second time 180° rotation of rotary table 12 and the operation of size-vertical moving means 46.

Further, in this embodiment, while the wire delivering means 35 is constituted to use a vacuum, the free end of wire C may be grasped at a predetermined position by a mechanical means to be delivered to the hand 15 or 16 at the retreat position.

As mentioned above, while this invention has been described with reference to the example of a magnetic head core, this invention can be applied to all cases where the coil is provided in the rotor of a motor and other closed holes.

As above mentioned, since the toroidal coil winding machine according to this invention is constituted fundamentally such that the table supporting a work is rotated to move the arms provided with hands for holding and releasing the wire relative to the rotary table, a remarkably compact machine can be provided with the simplified construction compared with prior machines with the arms rotated at the outside of the table. Also, since the free end of wire is located while being guided into the center of coil hole of work by the centering means and the guide means, the insertion of said end into the coil hole is facilitated. Further, since the free end of wire is always sucked and held to a size by the wire delivering means to be delivered to the hand, the length of wire held by the hand is constant, and the variance of insertion in the coil hole is eliminated. Furthermore, since the rotary table is provided with the vertical positioning moving means for vertically moving the rotary table by an amount corresponding to the wire diameter at each rotation, the wire can be wound in orderly fashion around the coil pole of a magnetic head core.

What is claimed is:

1. A coil winding machine comprising:

a rotatable table for supporting a workpiece having an opening;

wire clamping means for supporting one end of a wire to be inserted through said opening and being mounted on the table;

a first and a second arm arranged at two sides of the table movable relative to said table;

at least two hands for holding and releasing the wire which can be rotated around an axis parallel with an axis of said table and each respectively supported by one of said arms;

centering means mounted on the table for positioning a free end of the wire toward a central part of the opening when the wire is to be inserted into the opening by the hands;

guide means for guiding the free end to the central part of the opening;

wire delivery means arranged on the table at a side opposite to the guide means with said workpiece held therebetween, being movable relative to the opening for holding the free end of the wire inserted into the opening at one of said hands and delivering the free end towards the other of said hands while positioning the free end at a specified location; and moving means for raising or lowering said table by an amount corresponding to a diameter of the wire and winding the wire around the opening;

wherein said hands each comprise a fixed position pawl member which can be opened or closed around a guide shaft and a movable pawl member, said movable pawl member being movable relative to the fixed position pawl member by said guide shaft, a holding force on said wire of said movable pawl member being weaker than a holding force on said wire of said fixed position pawl member, and with a center line of said movable pawl member and the fixed position pawl member passing through a rotational center of the table.

2. A coil winding machine comprising:

a rotatable table for supporting a workpiece having an opening;

wire clamping means for supporting one end of a wire to be inserted through said opening and being mounted on the table;

a first and a second arm arranged at two sides of the table movable relative to said table;

at least two hands for holding and releasing the wire which can be rotated around an axis parallel with an axis of said table and each being supported by one of said arms;

centering means mounted on the table for positioning a free end of the wire towards a central part of the opening when the wire is to be inserted into the opening by the hands;

guide means for guiding the free end towards the central part of the opening;

delivery means arranged on the table at a side opposite to the guide means with said workpiece held therebetween, being movable relative to the opening, for holding the free end inserted into the opening at one of said hands and delivering the free end towards the other of the hands while positioning the free end to a specified location; and moving means for raising or lowering said table by an amount corresponding to a diameter of the wire and winding the wire around the opening;

wherein said centering means includes at least a first and a second shutter member perpendicular to a direction of movement of the free end, and wherein said first and second shutter members grasp therebetween the free end so as to position the free end.

3. A coil winding machine comprising:

a rotatable table for supporting a workpiece having an opening;

wire clamping means for supporting one end of a wire to be inserted through said opening and being mounted on the table;

a first and a second arm arranged at two sides of the table movable relative to said table;

at least two hands for holding and releasing the wire which can be rotated around an axis parallel with an axis of rotation of said table and each respectively supported by one of said movable arms;

centering means mounted on the table for positioning a free end of the wire toward a central part of the opening when the wire is to be inserted into the opening by the hands;

guide means for guiding the free end to the central part of the opening;

wire delivery means arranged on the table at a side opposite to the guide means with said workpiece held therebetween, being movable relative to the opening, for holding the free end inserted into the opening at one of said hands and delivering the free end towards the other of said hands while positioning the free end at a specified location; and moving means for raising and lowering said table by an amount corresponding to a diameter of the wire and winding the wire around the opening;

wherein said delivery means includes a suction path so as to pull the free end through said suction path.

4. A coil winding machine comprising:

a rotatable table for supporting a workpiece having an opening;

wire clamping means for supporting one end of a wire to be inserted through said opening and being mounted on the table;

a first and a second arm arranged at two sides of the table movable relative to said table;

at least two hands for holding and releasing the wire which can be rotated around an axis parallel with an axis of said table and each respectively supported by one of said movable arms;

centering means mounted on the table for positioning a free end of the wire toward a central part of the opening when the wire is to be inserted into the opening by the hands;

guide means for guiding the extremity free end to the central part of the opening;

wire delivery means arranged on the table at a side opposite to the guide means with said workpiece being held therebetween, for holding the free end inserted into the core opening at one of said hands and delivering the free end towards the other of said hands while positioning the free end at a specified location; and moving means for raising or lowering said table by an amount corresponding to a diameter of the wire and winding the wire around the opening;

wherein said moving means raises and lowers said table synchronously with a rotation of the table and provides an amount of raising or lowering of the table corresponding to a diameter of the wire.

* * * * *

UNITED STATES PATENT AND TRADEMARK OFFICE

CERTIFICATE OF CORRECTION

PATENT NO. : 4,917,317

DATED : April 17, 1990

INVENTOR(S) : Takao Iihama

It is certified that error appears in the above-identified patent and that said Letters Patent is hereby corrected as shown below:

Title page:

Abstract - Line 6 "mobable" should read --movable--

Signed and Sealed this

Thirtieth Day of July, 1991

*Attest:*

HARRY F. MANBECK, JR.

*Attesting Officer*

*Commissioner of Patents and Trademarks*